United States Patent [19]

Hill

[11] Patent Number: 4,475,375

[45] Date of Patent: Oct. 9, 1984

[54] MULTI-FLEX TUBE BENDING MANDREL

[76] Inventor: Ernest W. Hill, 106 Villa Park Dr., Highland Village, Tex. 75067

[21] Appl. No.: 460,124

[22] Filed: Jan. 24, 1983

[51] Int. Cl.[3] ..... B21D 9/03

[52] U.S. Cl. ..... 72/466

[58] Field of Search ..... 72/150, 466

[56] References Cited

U.S. PATENT DOCUMENTS

| | | | |
|---|---|---|---|
| 2,962,077 | 11/1960 | Condiff | 72/466 |
| 3,190,106 | 6/1965 | Spates | 72/466 |
| 3,408,850 | 11/1968 | Maier et al. | 72/466 |
| 3,490,259 | 1/1970 | Cwik | 72/466 |
| 3,750,455 | 8/1973 | Stange et al. | 72/466 |

FOREIGN PATENT DOCUMENTS

| | | | |
|---|---|---|---|
| 2417351 | 10/1979 | France | 72/466 |

*Primary Examiner*—Lowell A. Larson

*Attorney, Agent, or Firm*—Warren H. Kintzinger

[57] ABSTRACT

The mandrel is a high strength mandrel for bending tubing that is easily assembled in uniform pitch or multiple pitch ring spacing or combination of each embodiments. It is a mandrel with ring segments pivoting about their own center with the ring string flexible in any direction or multiple directions simultaneously. The mandrel has a detent structure tending to hold the ring string straight during loading of the tube over the mandrel using two detent balls and one spring in each ring ball segment in a mandrel linkage design absorbing, generally, the total flex angle within the first two links thereby allowing a larger link diameter for greater mandrel strength. The individual ring ball segments rotate about the centerline of the mandrel to effectively distribute wear around the circumference of each ring segment. The mandrel components include a body, a body split link retainer, a body link, a pivot ball, two detent balls and a single detent spring within each ring ball, a connecting link to each ball unit, two link retainer elements in a split retainer in each ring ball segment, a ball segment, a lock ring segment retainer and a socket head cap screw.

12 Claims, 5 Drawing Figures

MULTI-FLEX TUBE BENDING MANDREL

Figure 1:
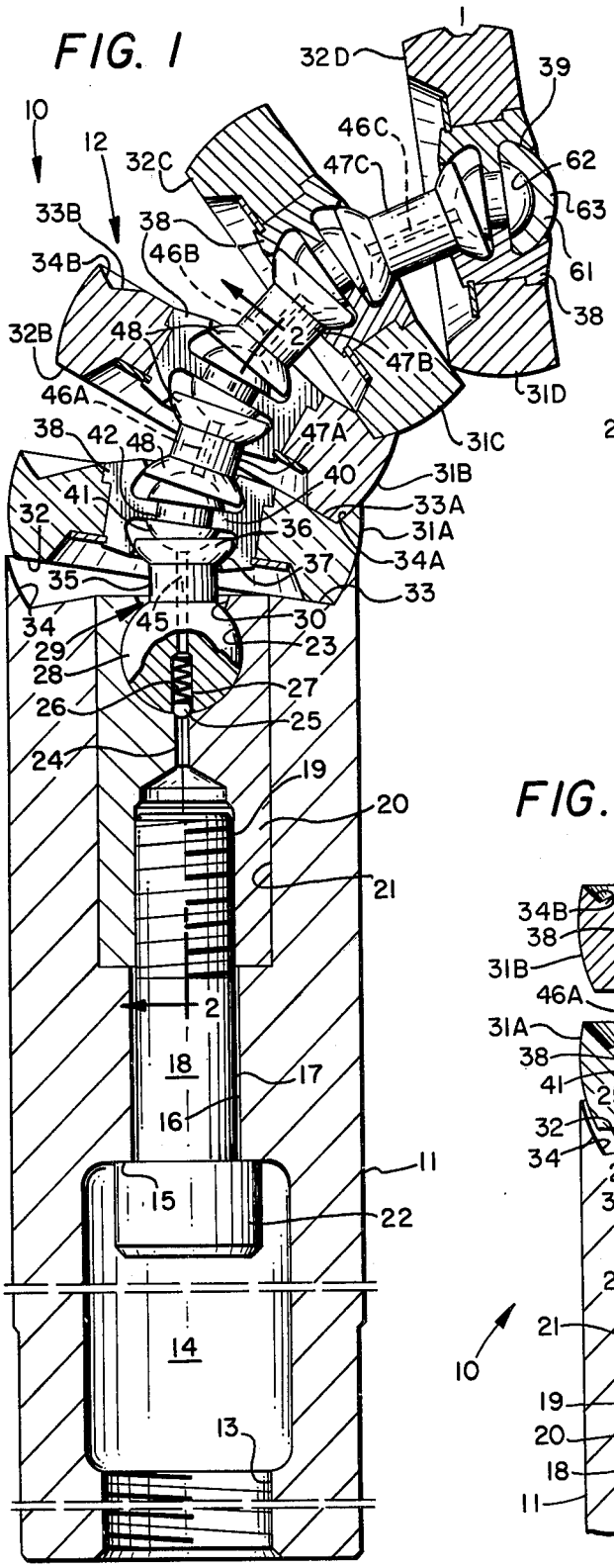

This invention relates in general to tube bending mandrels, and more particularly, to multi-flex tube bending mandrels that are high strength mandrels for bending metal tubing through a range of mandrel sizes for a wide range of tubing diameter sizes and wall thicknesses.

In the bending of tubular, or rectangular cross section, members by the "Draw Bending" method the tube is inserted in place, enclosing the tube bending mandrel and clamped by the clamp die to the straight portion of the bending form. A pressure die closes toward the bending form and the wiper die and the bending machine then rotates the clamp die and the bending form thereby drawing the tube by the wiper die and over the mandrel. The articulated ring ball segments of the mandrel maintain the desired shape of the tube through the draw bending operation. Further, the mandrel body in transmitting pressure from the pressure die to the radial portion of the of the bend form and to the wiper die aids in preventing wrinkles from forming during the draw bending operation.

The tube motion during draw bend forming generates significant friction between surfaces of the mandrel and the tube walls leading to undesired abrasion in some instances. Use is made of tool steel and alloy steel with surface treatments of chrome plating and/or nitriding of surfaces to minimize tool wear. Aluminum bronze alloys have also been used where tube material otherwise has had a tendency to gall. Synthetic lubricant materials and oils have been used at times to reduce frictiion during tube draw bending operations but the results can be messy imposing undesired clean up requirements.

In any event the linkages interconnecting ring ball segments must be adquately strong to resist tube to mandrel tool frictional forces developed during tube draw bending operation. During this operation successive increments of the tube are drawn over ring ball segment points of tangency with tangential stress and drag forces induced. Material in a tube being draw bent to the outside a neutral deformation zone is generally subject to tensile forces in both linear and radial directions. Material in the tube inside the neutral deformation zone is generally subject to compressive stress forces also in both linear and radial directions. Within the neutral deformation zone stress imposed during tube draw bending is less than the yield strength of the material of the tube while material outside is stressed in tension above the yield strength of the tube material and material inside the neutral deformation zone is subject to being stressed in compression above the material yield strength. Tensile stress above the yield point of the tube material particularly in tension cause the tube material to flow with the size and shape of tube material grain structure being altered with work hardening occurring.

While the outside material is in the yield plastic state it must be properly supported and guided by the ring ball segments in order to maintain desired tube shape. As the ratio of tube diameter with respect to tube wall thickness becomes greater the material tends to flatten between adjacent ring ball segments to therefore require that the segments be spaced with a closer pitch to minimize the amplitude of the expansion and flattening cycles as the tube is incremently passed over successive ring ball segments particularly the first two or three segments.

Radial deformation forces are transmitted to the tube as advancing material is being cold formed during the draw bending with the cold work hardening generally complete within the first 15 to 20 degrees of tube bend during the drawing action. Additional ring ball segments are used beyond the bending arc to counter residual flattening forces and keep the tube round. Within the bending arc the ring ball segments must be placed closer together for tube support through the cold work forming range and may then be spaced further apart after the bending arc since the cold working adds material hardening strength that helps the tube support itself. Use of fewer ring ball segments reduces friction drag and makes the tube draw forming action easier. Use of fewer ring ball segments can also reduce the total number of expansion and contraction cycles thereby reducing additional work hardening beyond the bending arc.

Generally with pre-existing and used tube draw bending mandrel designs the ring ball links are selected for the smallest pitch with the resultant structure of appropriate strength to place as many ball segments as possible within the bending arc. Further, the pitch selected has then also been generally used for the entire mandrel ring ball string to as many as ten or more ring balls being used. Many of these pre-existing mandrel designs have ring ball segments so attached to its respective link member that as the ring ball segment and link mandrel assembly flexes each ring ball segment remains perpendicular to its link. This results in each link assuming a chordal state as related to the tube centerline of bend. Thus, the ring ball segment assumes a radial displacement position from a line normal to the tube centerline. Such ring ball segment displacement is in undesired opposition to the flow of metal as the tube is being draw form bent. One significant problem with many existing tube draw bending mandrel designs is that they are complex, expensive and difficult to assemble.

It is, therefore, a principal object of this invention to provide an improved tube draw bending mandrel design that lends itself to easy assembly and disassembly and to efficient maintainance in the field.

Another object is to provide an improved mandrel design with high strength links that allow for uniform pitch or multiple pitch ring ball spacing or combinations thereof through selection of desired link element lengths at assembly of a mandrel.

A further object with such new improved tube draw bending mandrels is for ring ball segments to pivot about their own center.

Still another object is to provide an improved spring detent design for holding the mandrel ring ball string straight during loading of a tube over the mandrel.

Another object is to provide a mandrel ring ball string linkage design absorbing the total flex angle in the two links connected to each ring ball segment allowing larger link diameter and greater strength.

A further object is to minimize undesired opposition to the flow of metal as a tube is being draw form bent and for the ring ball segments to rotate about the centerline of the mandrel to distribute wear around the circumference of the ring ball segments.

Features of this invention useful in accomplishing the above objects include, in a multi-flex tube drawing mandrel, a mandrel design that is easily assembled in uniform pitch or multiple pitch ring ball spacing or a combination thereof through selection of uniform link elements or different length link elements. Ball ring segments pivot about their own center with the mandrel ball ring string flexible in any direction or multiple directions simultaneously. A two ball one spring detent structure in each ball ring segment holds the ball ring string straight during loading of the tube over the mandrel. The mandrel linkage design absorbs, generally, the total flex angle within the first two linked ball ring segments thereby allowing a larger link diameter for greater linkage and mandrel strength. The individual ball ring segments rotate about the centerline of the mandrel to effectively distribute wear around the circumference of each ball ring segment. The mandrel components include a body, a body split retainer, a body link, a pivot ball in each ball ring segment, two detent balls and a single detent spring within each pivot ball except the pivot ball of the mandrel end ring ball segment that in some instances may use a plug in place of one of the detent balls, a connecting link to each ball ring segment, two link retainer elements in a split retainer in each ball ring segment, a ball segment, a lock ring segment retainer and a socket head cap screw. Each pivot ball has a radial groove that helps hold the connecting link retainer halves in alignment with each other. The pivot balls also maintain proper spacing of connecting link spherical segment ends about the ball ring segment center. Further, each pivot ball with the two ball one spring detent structure held therein holds the connecting links in a straight line until required to flex by bending moment applied to the mandrel. The connecting links maintain the spacing between adjacent ring ball segments and allow the ring ball segments to pivot about the connective link spherical segment ends with the magnitude of such flexture limited by shoulders machined on the connecting link retainers. The connecting link retainers entrap the connecting link spherical segment ends and the pivot balls as assemblies with one assembly held together within each ball ring segment. A machined step on the outer circumference of each link retainer is held in abuting relation with a step on the interior of a ball ring segment by a lock ring in a groove in each link retainer bearing against a ball ring segment wall maintains ball ring segment alignment with the center of the pivot ball and the link retainer steps resists the frictional forces imparted by the tube to the ball ring segment as the tube draw bend is made. The spring lock ring blocks movement of the ball ring segment from its retainer mounting during tube loading on the mandrel. The circumference of each ball ring segment is formed with two radii, one struck from the ball ring segment pivot ball center and extending from a plane through the pivot center of ball ring segment to the exit face of the segment. The other radii is centered from the intersection of the ball ring segment center line and the circumference of the connecting link retainer, actually a center locus circle, for a machine generated curved surface extended from the plane through the pivot center of the ball ring segment to the entrance face of the segment with this surface providing a ramp for more gentle tube flow over the ball ring segment as the tube draw bending progresses.

Specific embodiments representing what are presently regarded as the best modes for carrying out the invention are illustrated in the accompanying drawings.

Figure 3:
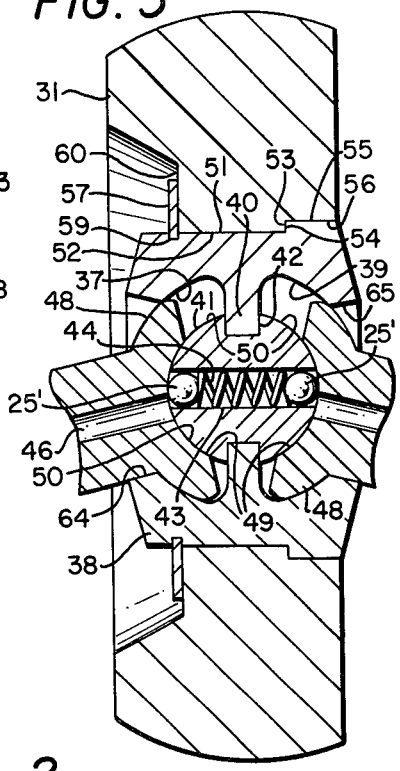
Figure 2:
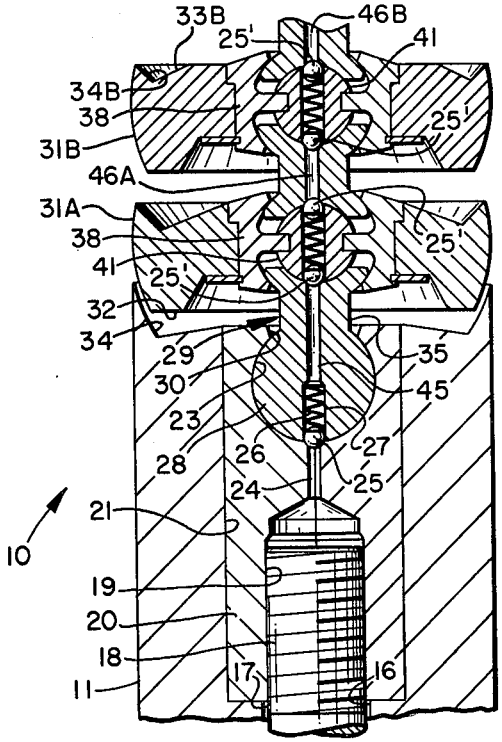
Figure 4:
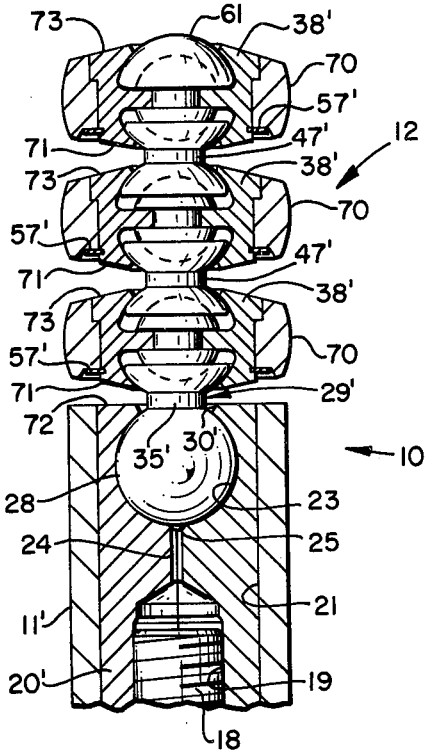
Figure 5:
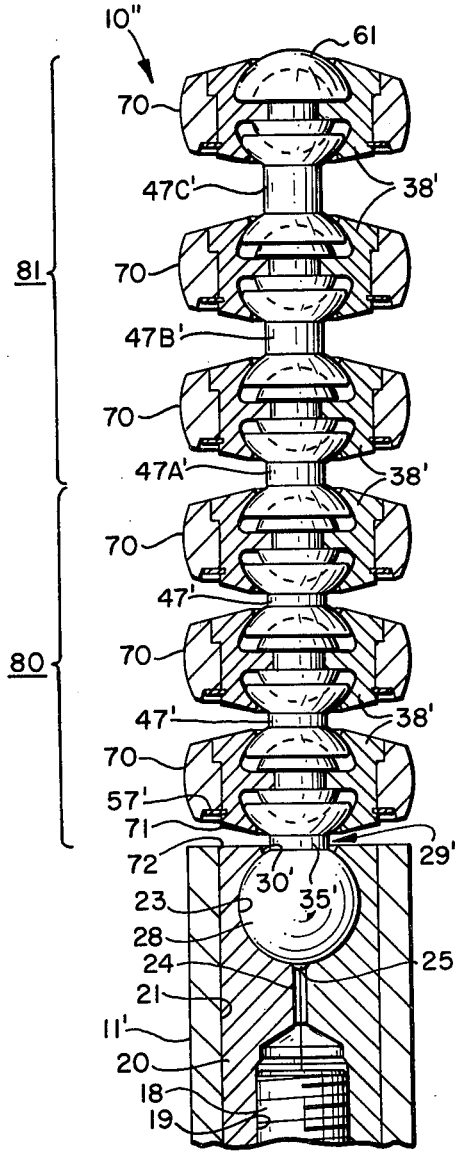

In the drawings:

FIG. 1 is an elevation view, mostly in section, of a tube draw bending mandrel in accord with applicant's teachings;

FIG. 2, a detailed view in partial section taken along line 2—2 of FIG. 1 showing mandrel ball ring, pivot ball, connecting link and link end retainer detail;

FIG. 3, an enlarged view of a ball ring segment and its mounting and link member interconnect in a mandrel ball ring segment chain;

FIG. 4, an elevation view, partially in section, like FIG. 1 of a tube draw bending mandrel with uniform pitch ball ring segments and equal length ball ring segment interconnect links; and, FIG. 5, an elevation view like FIGS. 1 and 4, of a tube draw bending mandrel with an initial uniform pitch ball ring segment section and thereafter a variable pitch ball ring segment section extending to the terminal exit end of the mandrel.

Referring to the drawings:

The tube draw bending mandrel 10 of FIG. 1 is shown to have a straight mandrel body 11 and a flexible multiple ball ring segment section 12. The straight mandrel body 11 has a threaded opening 13 at its lead end into which a holding anchor rod (not shown) is threaded to hold the tube draw bending mandrel 10 in place in the tube bending machine during successive cycles of tube draw bending over the mandrel 10. Mandrel body 11 also has chamber 14 continuing from threaded opening 13 to shoudler 15 with opening 16 through which the threaded shank 17 of bolt 18 extends to threaded engagement with threaded opening 19 of split socket member 20. The bolt 18 is tightened to securely seat split socket member 20 in mandrel body 11 opening 21 with bolt socket head 22 against shoulder 15. Split socket member 20 has a spherical recess 23 from which a small drilled opening 24 extends to partially receive a detent ball 25 resiliently biased to the detent state by a detent spring 26 contained in opening 27 within the spherical anchor end ball 28 of link member 29. The link member 29 is permitted to pivot from the straight detent engaged state, with application of side bending forces adequate to overcome the detent holding force, to a limited degree as stopped by a limit shoulder 30 machined as a limited mouth area or by pivot articulation position limit abutment of the first ball ring segment member 31 with face surface 32 in abutting contact, as shown in FIG. 1, with bottom face 33 of ball ring segment nesting recess 34 in the end of mandrel body 11. The socket member 20 with spherical recess 23 and spherical ball 28 interconnect the straight mandrel body 11 and the flexible multiple ball ring segment section 12. Link member 29 has spherical ball 28 at one end joined through cylindrical shank or rod 35 to spherical segment 36 at the other end that is captured in spherical recess 37 of link retainer 38 that, as shown in FIG. 2, is split in two duplicate halves for assembly purposes. Each link retainer 38, referring also to FIG. 3, is also formed with an additional spherical recess 39 that is separated from spherical recess 37 by an annular ring 40 that holds a pivot ball 41 in place and alignment by fitted projection into ball groove 42.

Each pivot ball 41 has a through detent opening 43 centered on an axis normal to the plane of ball groove 42 and a retainer annular ring 40 when in place within a ball ring segment member 31 (i.e. 31A, 31B, 31C and 31D). Each opening 43 holds two detent balls 25' and a resiliently compressed coil spring 44 positioned between the two detent balls 25' urging them outwardly in a detent action with center openings 45, 46A, 46B, and 46C, respectively, extended longitudinally through link members 47A, 47B and 47C. The spherical segment 36 of link member 29 and spherical segments 48 on opposite ends of link members 47A, 47B and 47C all have a like inner spherical segment surface 49 that slides over the respective spherical hemosphere half surface 50 of pivot ball 41. This structure aids in holding the captured spherical segment 36 and segments 48 in sliding relation to respective spherical recesses 37 without undesired slop in the ball ring segment link interconnects. Each split link retainer 38, with identical duplicate halves is retained in assembled relation with cylindrical surface 51 a close fit within cylindrical bore 52 of the respective ball ring segment member 31. A machined shoulder step 53 on the outer circumference of each link retainer is held in abuting relation with shoulder step 54 to cylindrical surface 55 and enlarged cylindrical bore 56, respectively. A lock ring 57 in a groove 59 in each link retainer 38 bears against a wall 60 of each respective ball ring segment 31 to, along with the abuting relation of retainer shoulder step 53 and ball ring segment shoulder step 54, maintain ball ring segment 31 alignment with the center of its pivot ball 41. The link retainer shoulder step 53 resists the frictional forces imparted by a tube to the ball ring segment 31 as the tube draw bend is made. Each spring lock ring 57 blocks movement of its ball ring segment 31 from its retainer 38 mounting during tube loading on the mandrel 10.

The outer circumferential surface of each ball ring segment 31 is formed with two radii, one struck from the ball ring segment pivot ball center and extending from a plane through the pivot center of ball ring segment to the exit face of the segment. The other radii is centered from the intersection of the ball ring segment center line and the circumference of the connecting link retainer, actually a center locus circle, for a machine generated curved surface extended from the plane through the pivot center of the ball ring segment with this surface providing a ramp for more gentle tube flow over the ball ring segment as the tube draw bending progresses.

In the tube draw bending mandrel 10 of FIGS. 1, 2, and 3, and other embodiments as well, the last ball ring segment such as segment 31D is provided with a hemisphere spherical segment member 61 with inner and outer spherical segment surfaces 62 and 63, respectively. The hemisphere spherical segment member 61 is captured in spherical recess 39 of the link retainer 38 in ball ring 31D to cap the outer end detent ball 25' in opening 43 of the end pivot ball 41 and maintain proper spacing within the pivot ball 41 and retainer 38 ball ring segment 31D assembly and prevent undesired slop much the same as with ball ring segment link interconnect end spherical segments 48.

The connecting links 29 and 47 maintain the cord spacing between mandrel body 11 and the first ball ring segment member 31A and between adjacent ball ring segment members 31 and allow the ball ring segment members 31 to pivot about the spherical ends of the links. The magnitude of this flexture is limited for some ball ring segment members 31 by annular shoulders 64 and 65 as indicated in FIG. 3 and with shoulder 64 with ball ring segment 31D in FIG. 1. Otherwise, as shown in FIG. 1, ball ring segment members 31 are nesting members 31A into nesting recess 34 with a portion of face surface 32 brought into abutting contact with bottom face 33 of ball ring segment nesting recess 34 in the end of mandrel body 11. A portion of face surface 32B of nesting member 31B is brought into abutting contact with face 33A in nesting recess 34A of segment member 31A, and a portion of face surface 32C is brought into abutting contact with face 33B in nesting recess 34B of segment member 31B as the mandrel is flexed to the sharpest radius tube bending state of FIG. 1. The mandrel linkage design absorbs, generally the total flex angle within the first two linked ball ring segments thereby allowing a larger link diameter for greater linkage and mandrel strength. This mandrel is quite effective with the articulated ball ring segments generally maintaining ovality of the tube being draw bent, and with the mandrel body transmitting pressure from the pressure die to the radial portion of the bend form and to the wiper die to prevent wrinkles from forming. In addition to two links dividing the flex angle, in each mandrel ball ring segment, between them and thereby allowing a larger link diameter for greater strength the ball ring segments are allowed to rotate about the centerline of the mandrel to distribute wear around the circumference of the ball ring segment. With the embodiment of FIGS. 1 and 2 ball ring segments 31 are placed closer together to support the tube where cold forming takes place and then progressively further apart beyond the bending arc since the cold working adds strength to help the tube support itself. Fewer ball ring segments reduces draw form bending friction and makes the forming easier. Further, use of ball ring segments also reduces the number of tube material expansion and contraction cycles to thereby reduce additional work hardening induced beyond the bending arc. In this design the ball ring segments pivot about their own center and rotate generally about a common center through the main arc of tube draw bending with radius centers being maintained essentially properly on the tube center through the arc of draw bending. This is quite advantageous over mandrel structures where ball ring segments are attached to links so as to assume a chordal position with respect to the centerline of the bend and a position of radial displacement from a line normal to the center line through the center of the tube. Such previous structures with ball ring segment off center displacement opposes the flow of metal during the tube draw bending action in an undesired forming action.

Referring now to the tube draw bending mandrel 10' of FIG. 4 uniform pitch ball ring segments 70 with a link member 29' extending from mandrel body 11', much like its counterpart in the embodiment of FIGS. 1 and 2, and equal length ball ring segment 70 interconnect links 47' are shown in a relatively short three ball ring segment mandrel extended from body 11'. Elements the same as with the embodiment of FIGS. 1 and 2 are numbered the same and where quite similar are given primed identification numbers as a matter of convenience with duplicated function not repeated in full detail again. Flexing of the multiple ball ring segment section 12' is limited by abuting contact of a side surface 71 of link retainer 38' with exposed end 72 of split socket member 20' and thereafter down section 12' of the mandrel abuting contact of the next ring segment link retainer surface 71 with an opposite side retainer surface 73 of the preceding ball ring segment 70. This embodiment is quite useful in draw bending sharp small radius bends in medium to heavy wall tubes in a flexible mandrel that, just the same as with the embodiment of FIGS. 1 and 2, allows each ball ring segment to pivot about its own center while accomodating the total flex angle for each ball ring segment into two links. This permits use of larger link diameters for higher strength.

The tube draw bending mandrel 10″ of FIG. 5 is substantially the same as the mandrel 10′ of FIG. 4 from the mandrel body 11′ through the uniform pitch section 80 with equal length ball ring segment 70 interconnect links 47′ through the first three ring segments 70. With mandrel 10″ however, the hemisphere spherical segment member 61 is removed from the ball ring segment 70 end of uniform pitch section 80 and used in the last ball ring segment 70 of the variable pitch ball ring segment section 81 of the mandrel. Link member 47A′, used to interconnect the last ball ring segment 70 of the uniform pitch section 80 and the first ball ring segment 70 of the variable pitch ball ring segment section 81, is longer than link members 47′ and link members 47B′ and 47C′ are successively progressively longer than link member 47A′ in ABC order. Thus, a mandrel 10″ is provided having a combination uniform pitch section and multiple pitch section as a multi-flex tube bending mandrel.

In all these embodiments with two links dividing the flex angle, in each ball ring segment, between them allows not only larger link diameter for greater link member strength but also more link retainer spherical recess lip material to annular shoulders 64 and 65 in holding captured link end spherical segments. This advantageously provides increased mandrel strength in resisting strong longitudinal friction forces imposed on a multi-flex tube mandrel during tube draw bending operations.

Whereas this invention has been described with respect to several embodiments thereof, it should be realized that various changes may be made without departure from the essential contributions to the art made by the teachings hereof.

I claim:

1. A multi-flex tube draw bending mandrel having a flexible multiple ball ring segment section; comprising a plurality of ball ring segments in said flexible multiple ball ring segment section; a link member having two link pivot means ends interconnecting two adjacent ball ring segments of said plurality of ball ring segments; mount means for said flexible multiple ball ring segment section including link means having a link pivot means end like said two link pivot means ends of said link member; pivot interconnect means in at least one ball ring segment of said plurality of ball ring segments capturing link pivot means ends of two of said links for articulation of the respective ball ring segment with respect to both link pivot means ends captured in that ball ring segment; and wherein each segment of said plurality of ball ring segments comprises: a ball ring member having an outer annular surface curved from a forward face to a rear face; a cylindrical opening through said ball ring member; a split link retainer mounted in the cylindrical opening through said ball ring member; split link retainer mount holding means blocking movement of said split link retainer from the cylindrical opening through said ball ring member; said split link retainer being formed with two duplicate opposite side facing inner spherical segment surfaced cavities separated by an internally projecting annular ring; and a pivot ball, with a ball groove, held in place by projection of said internally projecting annular ring into said ball groove with said internally projecting annular ring and said ball groove so fitted as to hold them to substantially the same reference center.

2. The multi-flex tube drawing mandrel of claim 1, wherein said link pivot means ends on said link members and on said link means are in the form of duplicate spherical segments captured for a relative moving sliding fit in the spherical segment cavity space between a respective said inner spherical segment surfaced cavity and an outer spherical segment surface portion of said pivot ball; and with said duplicate spherical segments of the links being shorter than the spherical segment cavity space for clearance space from said internally projecting annular ring projecting inwardly within said split link retainer permitting a range of articulated relative pivotal movement between a ball ring segment and a link connected thereto.

3. The multi-flex draw bending mandrel of claim 2, wherein articulate movement between two links connected to the same ball ring segment is divided between them with the center of articulations for the two links being substantially common to the center of articulative rotative flexing movement of that ball ring segment.

4. The multi-flex draw bending mandrel of claim 3, wherein detent means is included with each said pivot ball with a detent opening through the ball centered on a center axis normal to the plane of said ball groove; two detent balls, and resiliently compressed spring means positioned between said two detent balls in the detent opening through the ball; links connected to the respective ball ring segment in articulating sliding contact with said pivot ball each having a center detent opening into which the two detent balls are urged in detent action to hold the ball ring string straight during loading of a tube over the mandrel prior to draw bending of the tube.

5. The multi-flex draw bending mandrel of claim 4, wherein said link retainer mount holding means includes: cooperative engaging shoulder means on said link member and shoulder means in said cylindrical opening through said ball ring member; and a lock ring, mounted in a groove of said link retainer, positioned for contact with a face of said ball ring member.

6. The multi-flex draw bending mandrel of claim 5, wherein the said outer annular surface curved from a forward face to a rear face of a ball ring member is formed with two radii, one struck from the ball ring segment pivot ball center and extending from a plane through the pivot center of the ball ring segment to the exit face of the ball ring segment; and the other radii is centered from the intersection of the ball ring center line and the circumference of the connecting link retainer, a center locus circle.

7. The multi-flex draw bending mandrel of claim 1, wherein the rear face of at least one of said ball ring members is provided with a ball ring segment nesting recess into which is received a portion of the front face and leading edge of the outer annular surface of the next adjacent ball ring member when the flexible multiple ball ring segment section is flexed to its articulated limit.

8. The multi-flex draw bending mandrel of claim 7, wherein said mount means includes, a mandrel body provided with a ball ring segment nesting recess in the end thereof shaped to receive a portion of the front face and leading edge of the outer annular surface of the first lead ball ring member when the flexible multiple ball ring segment section is flexed close to its articulation limit.

9. The multi-flex draw bending mandrel of claim 2, wherein each said spherical segment cavity space in said split link retainers has an opening defining a link retainer shoulder; link means rods extending through said openings in the split link retainer having adequate clearance from said link retainer shoulders to accomodate the full range of articulated movement of the link means relative to respective ball ring segments.

10. A multi-flex tube draw bending mandrel having a flexible multiple ball ring segment section comprising: a plurality of ball ring segments in said flexible multiple ball ring segment section; a link member having two link pivot means ends interconnecting two adjacent ball ring segments of said plurality of ball ring segments; mount means for said flexible multiple ball ring segment section including link means having a link pivot means end like said two link pivot means ends of said link member; pivot interconnect means in at least one ball ring segment of said plurality of ball ring segments capturing link pivot means ends of two of said links for articulation of the respective ball ring segment with respect to both link pivot means ends captured in that ball ring ring segment; wherein articulation of the respective ball ring segment with respect to both link pivot means ends captured in that ball ring segment is about a single center of pivot articulation; a plurality of said link members join a plurality of said ball ring segments in series chain relation; and wherein said plurality of link members are of different lengths in a variable pitch ball ring segment section.

11. The multi-flex tube draw bending mandrel of claim 10, wherein said plurality of said link members are of increasing length as they are progressively further from said mount means for said flexible multiple ball ring segment section to provide an increasing pitch ball ring segment section extending to a terminal exit end of the mandrel.

12. A multi-flex tube draw bending mandrel having a flexible multiple ball ring segment section comprising: a plurality of ball ring segments in said flexible multiple ball ring segment section; a link member having two link pivot means ends interconnecting two adjacent ball ring segments of said plurality of ball ring segments; mount means for said flexible multiple ball ring segment section including link means having a link pivot means end like said two link pivot means ends of said link member; pivot interconnect means in at least one ball ring segment of said plurality of ball ring segments capturing link pivot means ends of two of said links for articulation of the respective ball ring segment with respect to both link pivot means ends captured in that ball ring segment; wherein articulation of the respective ball ring segment with respect to both link pivot means ends captured in that ball ring segment is about a single center of pivot articulation; a plurality of said link members join a plurality of said ball ring segments in series chain relation; and wherein some of said link members are of substantially equal length; and some of said link members are of different lengths providing a tube draw bending mandrel having an initial uniform pitch ball ring segment section, and thereafter a variable pitch ball ring segment section extending to the terminal exit end of the mandrel.

* * * * *